US006581796B1

(12) United States Patent
Pilkinton

(10) Patent No.: US 6,581,796 B1
(45) Date of Patent: Jun. 24, 2003

(54) TRASH RECEPTACLE

(76) Inventor: Les Pilkinton, 8107 Birnam Wood Dr., McLean, VA (US) 22102

( * ) Notice: Subject to any disclaimer, the term of this patent is extended or adjusted under 35 U.S.C. 154(b) by 0 days.

(21) Appl. No.: 10/119,029

(22) Filed: Apr. 10, 2002

(51) Int. Cl.[7] ..... B65D 25/16
(52) U.S. Cl. ..... 220/495.04; 220/771; 220/772
(58) Field of Search ..... 220/908, 908.1, 220/495.04, 671, 675, 770, 771, 772, 752, 495.06, 495.11

(56) References Cited

U.S. PATENT DOCUMENTS

| | | | | | |
|---|---|---|---|---|---|
| 140,527 | A | * | 7/1873 | Munson, Jr. | |
| 1,268,582 | A | * | 6/1918 | Knox | |
| 3,331,529 | A | * | 7/1967 | Slapnik | |
| 3,383,009 | A | * | 5/1968 | Weikert | |
| 3,996,173 | A | * | 12/1976 | Heichele et al. | 524/322 |
| 4,243,577 | A | * | 1/1981 | Chiao | 524/526 |
| 4,708,258 | A | * | 11/1987 | Shaw et al. | 220/284 |
| 4,832,200 | A | * | 5/1989 | Deaton et al. | 206/508 |
| D328,425 | S | * | 8/1992 | Brightbill | D9/424 |
| 5,170,906 | A | * | 12/1992 | Kochelek | 220/495.06 |
| 5,303,841 | A | * | 4/1994 | Mezey | 220/555 |
| 5,547,104 | A | * | 8/1996 | Parker | 220/769 |
| 5,641,090 | A | * | 6/1997 | Kowalski et al. | 206/508 |
| 5,967,362 | A | * | 10/1999 | Corbin | 220/648 |
| 5,992,628 | A | * | 11/1999 | Vermilion et al. | 206/447 |
| 6,308,858 | B1 | * | 10/2001 | Koefelda | 220/608 |

* cited by examiner

*Primary Examiner*—Lee Young
*Assistant Examiner*—Joseph C. Merek
(74) *Attorney, Agent, or Firm*—Michael J. Foycik, Jr.

(57) ABSTRACT

A trash receptacle includes an upper rim, four sidewalls, and a lid. The trash receptacle includes a pair of recessed channel portions disposed in opposite sidewalls. A pair of handles are disposed in each of the channel portions. The channel portions each include a bottom channel wall and channel sidewalls. The lid also serves as a collar for the bottom of the trash receptacle 100. The interior of the channel portion has an upper, rounded portion which leads smoothly to the bottom channel wall. A label can be provided on the side of the trash receptacle. The structure of the trash receptacle serves to prevent development of a vacuum between the walls of the trash receptacle and the trash bags. The trash receptacle 100 is adapted to receive trash bags or plastic liners, and has improved resistance to formation of a vacuum between the walls of the trash receptacle and the trash bags.

6 Claims, 6 Drawing Sheets

TRASH RECEPTACLE

FIELD OF THE INVENTION

The present invention relates to an improved trash receptacle. More particularly, the present invention relates to an improved trash receptacle for receiving a trash bag, the trash receptacle being so constructed as to reduce or eliminate problems associated with trash bag removal caused by air vacuum between the trash bag and the walls of the trash receptacle.

BACKGROUND OF THE INVENTION

Trash receptacles are known in the prior art. For example, recycling containers, garbage cans, wastebaskets, and the like are known. It is also known to provide a trash can liner, such as a trash bag or garbage bag, inside such containers. Such trash can liners are generally formed of thin, plastic material.

However, when inverting such trash receptacles, a vacuum can form between the trash bags and the walls of the trash receptacle, slowing removal of the trash bag. Further, upon inverting the trash receptacle in order to empty it, ideally the trash bags would simply slide out. Due to the formation of a vacuum between the walls of the trash receptacle and the trash bags, however, such removal is difficult.

Furthermore, for medical waste and trash receptacles, metal needles and syringes may be present in the trash. Such metal needles and syringes can readily penetrate the thin plastic trash bags used, particularly when manual pulling occurs during removal of the trash bags. Such metal needles and syringes can become lodged between the walls of the trash receptacle and the trash bags, and can even stick to the walls of the trash receptacle after removal of the trash bags. Such metal needles and syringes, or other sharp objects, therefore can eventually pose a hazard when using a trash receptacle with trash bags in which a vacuum develops between the walls of the trash receptacle and the trash bags resisting removal of the trash bags.

Therefore, it is a problem in the art to provide a trash receptacle which prevents development of a vacuum between the walls of the trash receptacle and the trash bags, in which the presence of a vacuum would resist removal of the trash bags.

SUMMARY OF THE INVENTION

From the foregoing, it is seen that it is a problem in the art to provide an article or device meeting the above requirements. According to the present invention, an article or device are provided which meets the aforementioned requirements and needs in the prior art. Specifically, the device according to the present invention provides a trash receptacle which prevents development of a vacuum between the wails of the trash receptacle and the trash bags.

Furthermore, the present invention provides a device which includes a removable lid Which can also serve as a base or stand for the trash receptacle which prevents development of a vacuum between the wails of the trash receptacle and the trash bags.

More particularly, the invention relates to a trash receptacle adapted to receive trash bags, and having improved resistance to formation of a vacuum between the walls of the trash receptacle and the trash bags.

The invention includes a trash receptacle having a generally rectangular cross section with rounded corners, and having one pairs of recessed handles on at least one side of the trash receptacle. Furthermore, the invention includes a recessed channel extending into the interior of the trash receptacle, the handles being disposed with the recessed channel. The presence of the recessed channel assists in breaking any vacuum forming between the trash bags and the walls of the trash receptacle, and in preventing formation of such a vacuum.

The lid of the present invention is configured to serve also as a collar in order to permit stacking of two or more trash receptacles. The trash receptacle is preferably formed of medium density polyethylene, and can bear a label or labels for identification of the contents of the trash receptacle. The color is preferably teal, and the wall thickness of the trash receptacle is preferably about 0.150 inches, with a preferred capacity of 28 gallons. The material forming the trash receptacle is preferably recyclable and is also preferably UV resistant.

The handles used in the present invention are preferably heavy duty, ergonomically placed for safe lifting and dumping. The handles are recessed for safety, ergonomics, ease of stacking, and ease of cleaning.

The outer surface of the trash receptacle is preferably smooth to facilitate cleaning with a pressure washer and/or sterilization. The trash receptacle according to the present invention preferably has no moveable or removable parts.

Other objects and advantages of the present invention will be more readily apparent from the following detailed description when read in conjunction with the accompanying drawings.

DETAILED DESCRIPTION OF THE INVENTION

Figure 1:
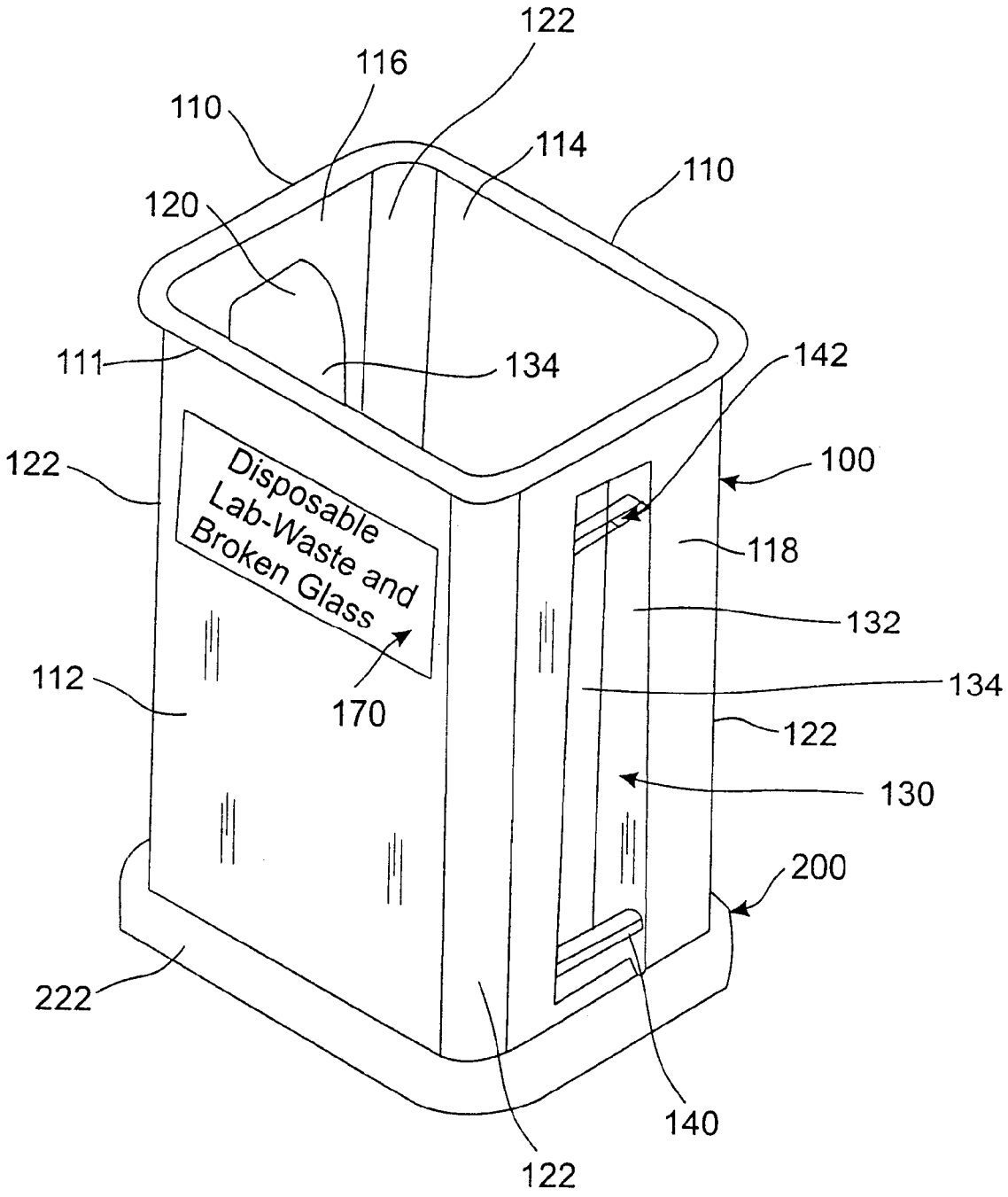
FIG. 1 is a perspective view of a trash receptacle according to the present invention, in which the lid of the trash receptacle is disposed beneath the trash receptacle.

As shown in FIG. 1, a trash receptacle 100 includes an upper rim 110, sidewalls 112, 114, 116, and 118, and a lid 200. The trash receptacle 100 includes a pair of recessed channel portions 130, 130 disposed in opposite sidewalls 116, 118 respectively. The trash receptacle 100 includes four rounded corners 122, 122, 122, 122.

A pair of handles 140, 142 are disposed in each of the channel portions 130, 130 of the trash receptacle 100. The channel portions 130, 130 each include a bottom channel wall 134 and channel sidewalls 132, 132. The upper rim 110 has a lower edge 111.

In FIG. 1, the lid 200 of the trash receptacle 100 is disposed beneath the trash receptacle 100. In this view, the lid 200 has a lid sidewall 222 which serves as a collar for the bottom of the trash receptacle 100.

As seen in FIG. 1, the interior of the channel portion 130 has an upper, rounded portion 120 which leads smoothly to the bottom channel wall 134. A label 170 can be provided on the side of the trash receptacle 100. It will be understood that such label is optional, and that more than one label or indicia may be provided at more than one location. Further, the lid 200 can likewise bear indicia, although in the preferred embodiment no indicia is provided on the lid 200.

As can be seen in FIG. 1, the present invention provides a trash receptacle 100 which includes a removable lid 200 which can also serve as a base or stand for the trash receptacle 100. The structure of the trash receptacle 100 as shown in FIG. 1 serves to prevent development of a vacuum between the walls of the trash receptacle and the trash bags. The trash receptacle 100 is adapted to receive trash bags (not shown), and has improved resistance to formation of a vacuum between the walls of the trash receptacle 100 and the trash bags.

The presence of the recessed channels 130, 130 assists in breaking any vacuum forming between the trash bags (not shown) and the walls 112, 114, 116, 118 of the trash receptacle 100, and in preventing formation of such a vacuum.

The lid 200 is configured to serve also as a collar in order to permit stacking of two or more trash receptacles 100. The trash receptacle 100 is preferably formed of medium density polyethylene, and can bear a label or labels for identification of the contents of the trash receptacle. The color is preferably teal, and the wall thickness of the trash receptacle is preferably about 0.150 inches, with a preferred capacity of 28 gallons. The material forming the trash receptacle is preferably recyclable and is also preferably UV resistant. The total weight of the trash receptacle body and the lid is approximately 14 pounds. Furthermore, the materials forming the trash receptacle body are preferably impact to a temperature of minus forty degrees Centigrade.

The handles 140, 142 used in the present invention are preferably heavy duty, ergonomically placed for safe lifting and dumping. The handles are recessed for safety, ergonomics, ease of stacking, and ease of cleaning. The entire trash receptacle 100 and lid 200 can be formed by conventional manufacturing processes, such as molding, vacuum molding, injection molding, and the like.

The outer surface of the trash receptacle 100 is preferably smooth to facilitate cleaning with a pressure washer and/or sterilization. The trash receptacle 100 preferably has no moveable or removable parts.

Figure 2:
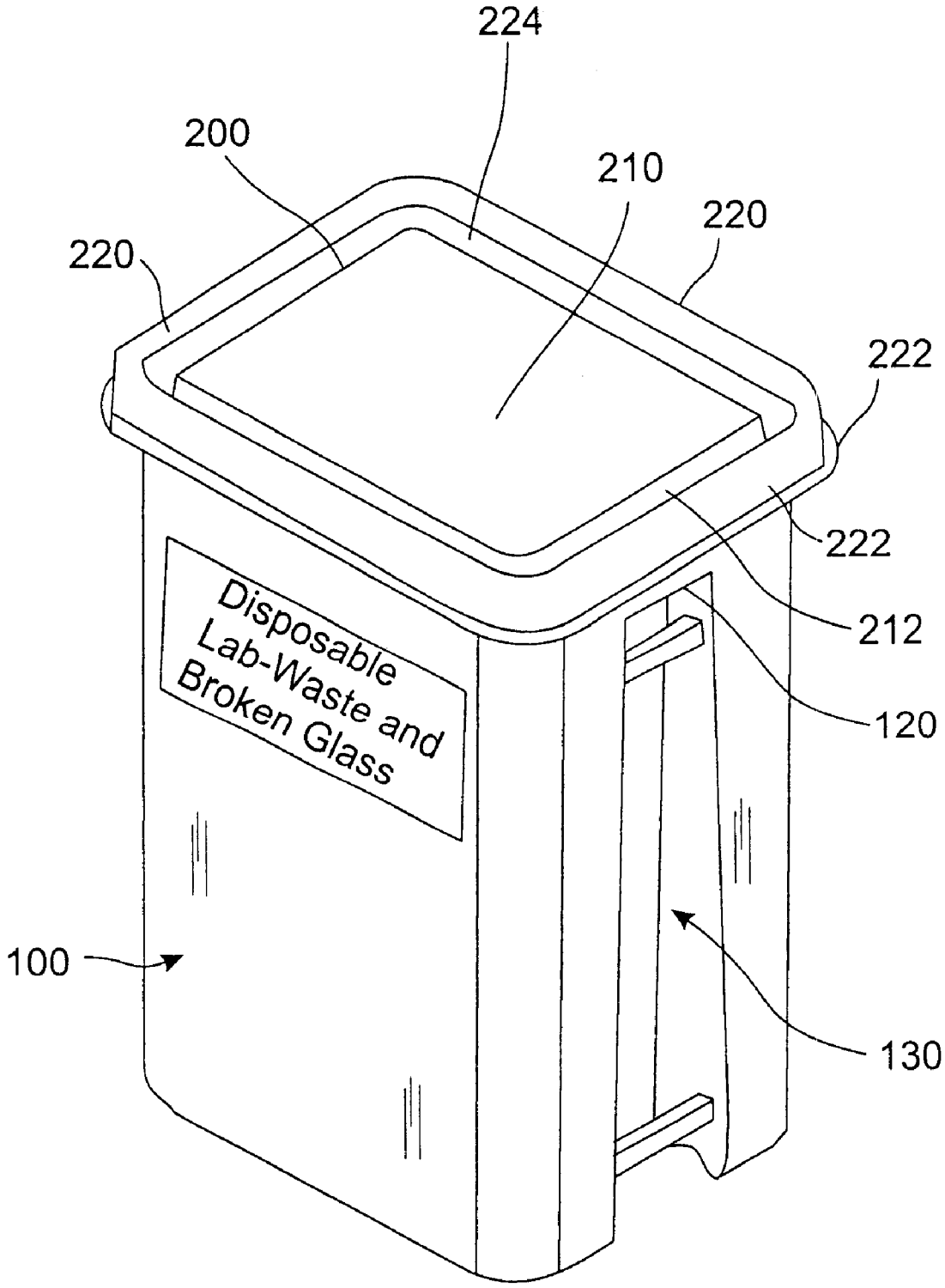
FIG. 2 is a perspective view of the trash receptacle of FIG. 1, in which the lid of the trash receptacle is disposed on top of the trash receptacle.

FIG. 2 is a perspective view of the trash receptacle of FIG. 1, in which the lid 200 of the trash receptacle 100 is disposed on top of the trash receptacle 100. The lid 200 is seen in FIG. 2 as including a top portion 210, a channel 224 surrounding the top portion 210, an upper rim portion 220 surrounding the channel 224, and the lid sidewall 222. As seen in FIG. 2, the channel 130 is open at its bottom portion, and is bounded at its top portion by the portion 120 of the trash receptacle 100.

Figure 3:
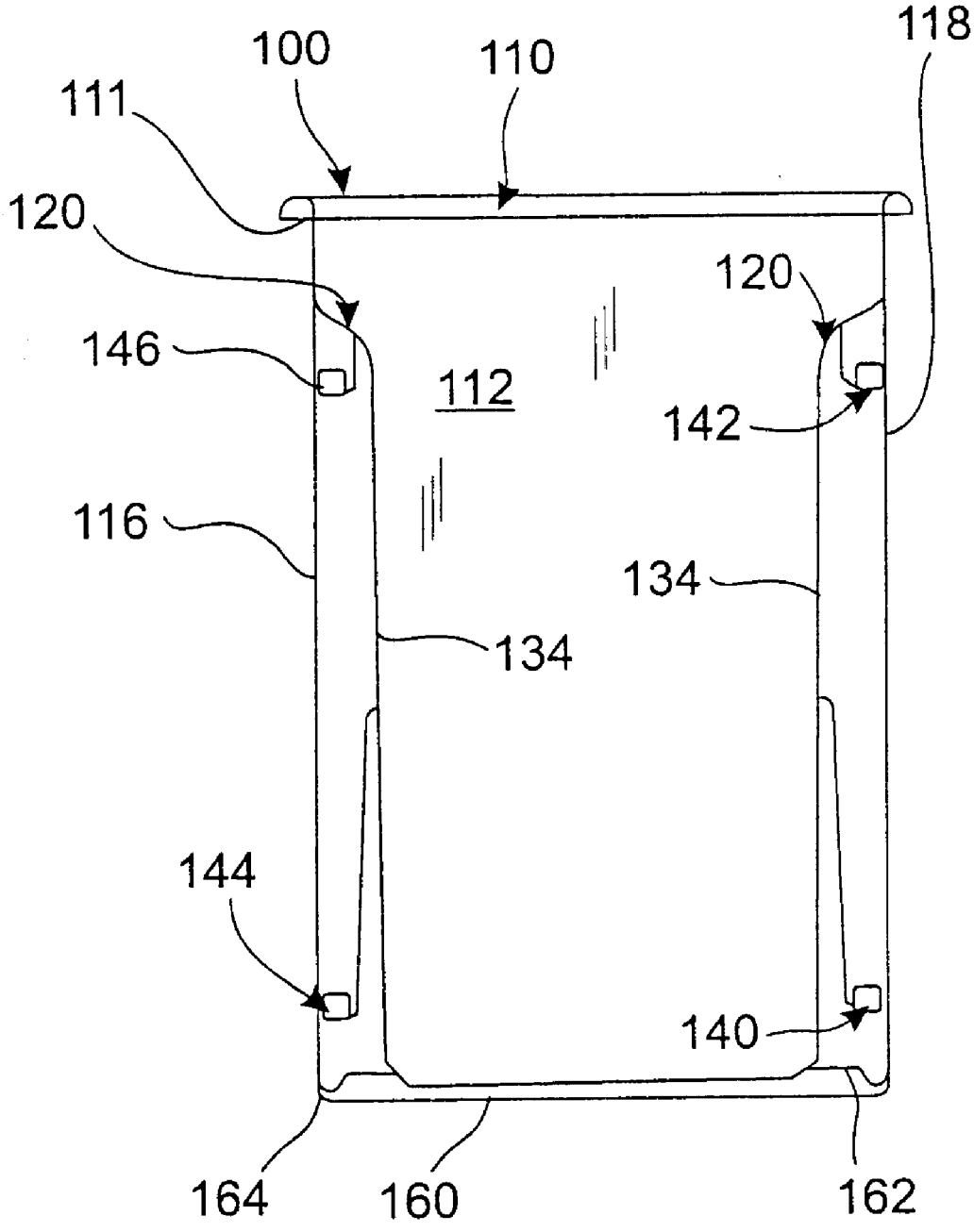
FIG. 3 is a front elevational view of the trash receptacle of FIG. 1, showing in dashed outline the recessed channel portion and handles.

FIG. 3 is a front elevational view of the trash receptacle of FIG. 1, showing in dashed outline the recessed channel portion and handles. In this view, the sidewall 112 is seen in elevational view, sidewalls 116 and 118 are visible, and the bottom channel walls 134, 134 are seen in dashed outline.

FIG. 3 also shows a bottom wall 160 of the trash receptacle 100, and a bottom wall recess channel 162 surrounded by a bottom wall raised rim portion 164. FIG. 3 also shows handles 144 and 146 adjacent the wall 116, and handles 140, 142 adjacent the wall 118.

Figure 4:
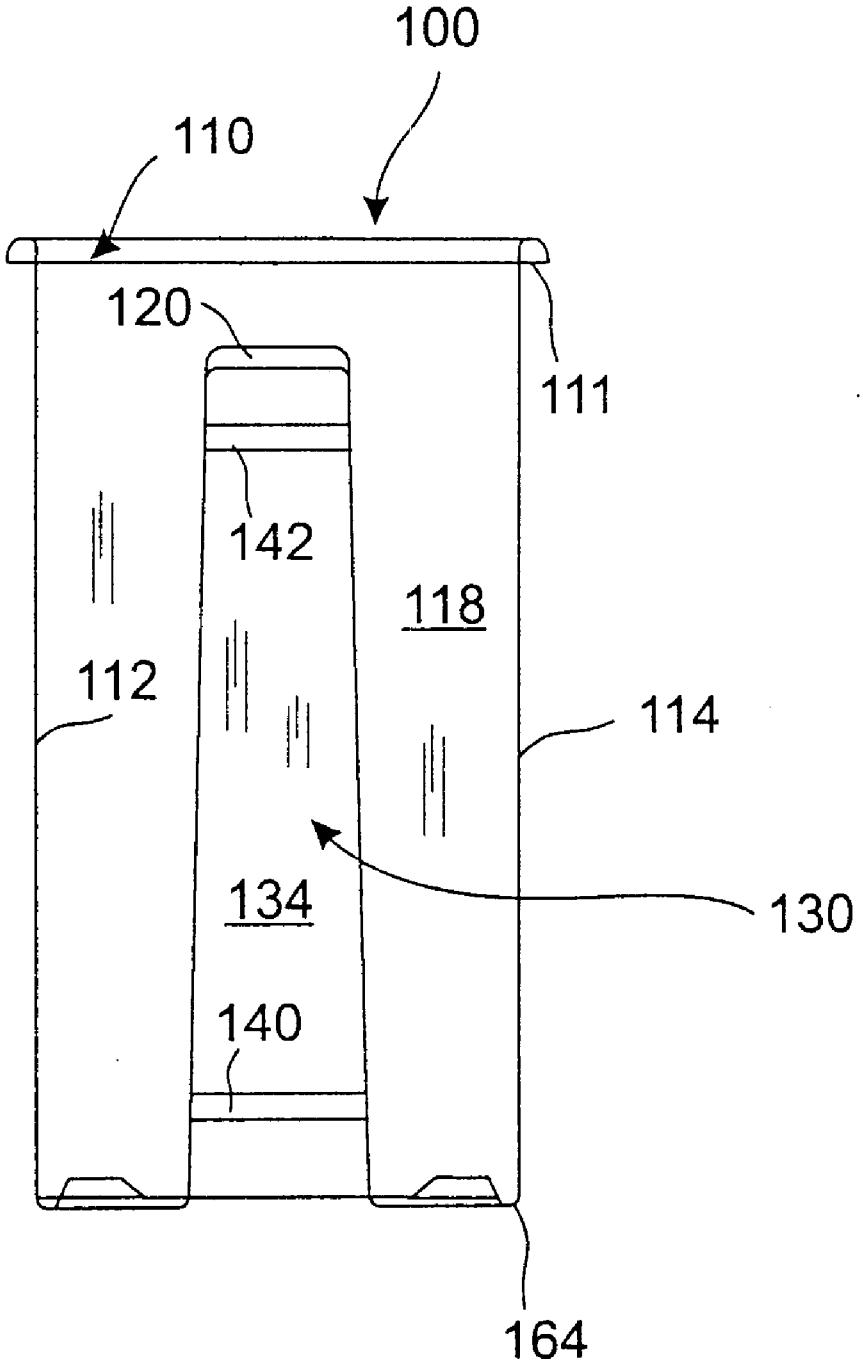
FIG. 4 is a side elevational view of the trash receptacle of FIG. 3, showing the recessed channel portion and handles.

FIG. 4 is a side elevational view of the trash receptacle 100 of FIG. 3, showing the recessed channel portion 130 having the bottom channel wall 134 and the handles 140 and 142. The upper, rounded portion 120 bounding the top of the channel portion 130 is also seen in FIG. 4.

Figure 5:
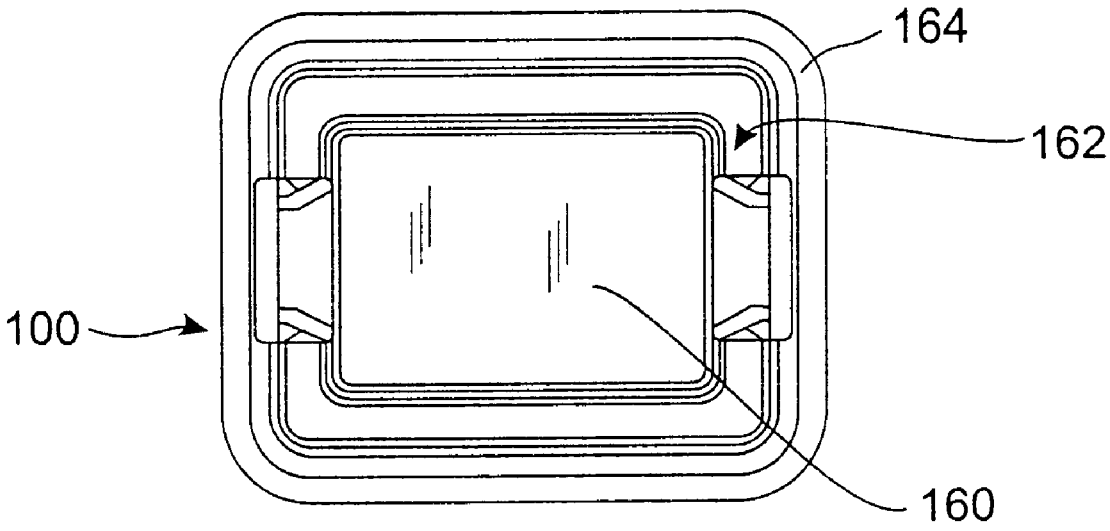
FIG. 5 is a bottom elevational view of the trash receptacle of FIGS. 3 and 4, showing in dashed outline the interior construction.

FIG. 5 is a bottom elevational view of the trash receptacle 100 of FIGS. 3 and 4, showing in dashed outline the interior construction. The bottom wall 160 of the lid 200 is seen in elevational view in this figure. The bottom wall 160 is surrounded by the recess channel 162, and the channel 162 in turn is surrounded by the bottom wall raised rim portion 164.

Figure 6:
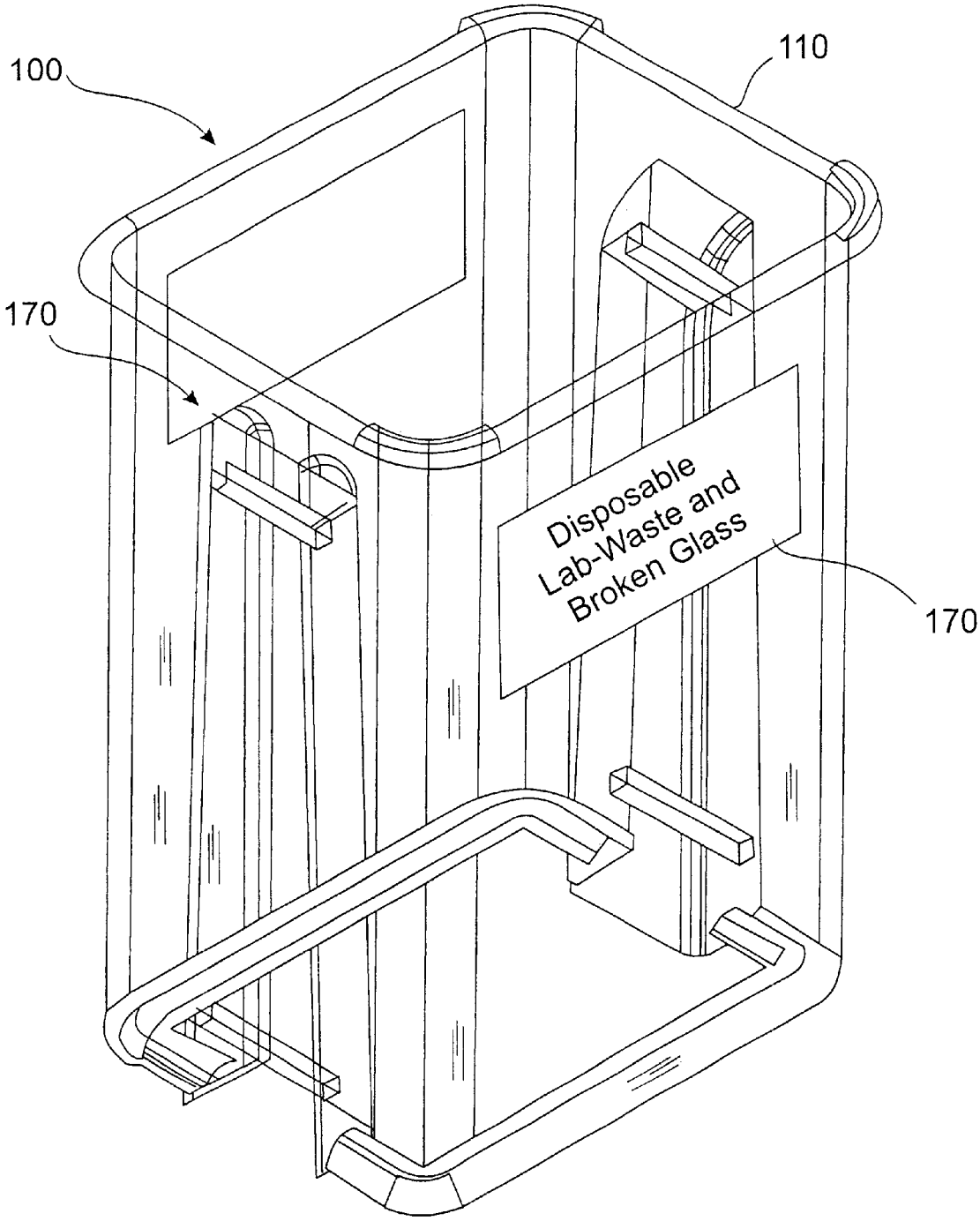
FIG. 6 is a schematic diagram using frame-wire elements to illustrate the construction of the trash receptacle according to the present invention.

FIG. 6 is a schematic diagram using frame-wire elements to illustrate the construction of the trash receptacle according to the present invention. Numerals are omitted for most of the parts for the sake of clarity, it being evident that this structure corresponds with the embodiments shown in FIGS. 1–5 hereinabove.

It will be understood that many variations are possible for the wall materials, thicknesses, coloration, surface texture, and other properties, and any such variations are contemplated as being within the scope of the present invention.

The invention being thus described, it will be evident that the same may be varied in many ways. Such variations are not to be regarded as a departure from the spirit and scope of the invention and all such modifications are intended to be included within the scope of the claims.

What is claimed is:

1. An improved trash receptacle for receiving a trash can liner, comprising:

a trash receptacle body having an upper rim, four substantially planar sidewalls, and a bottom wall;

the bottom wall of the trash receptacle body being substantially planar and having a rim portion;

a first recessed channel disposed in a first one of the four sidewalls, said first recessed channel extending in a direction which is transverse to said bottom wall;

said first recessed channel having substantially planar channel sidewalls extending transversely to said first sidewall of said trash receptacle body, and said first recessed channel having a bounding wall which extends transversely to said channel sidewalls;

said first recessed channel having a lowermost portion and an uppermost portion, and where a depth of said first recessed channel has a maximum depth adjacent said bottom wall, and tapers in depth in a direction toward said uppermost portion of said first recessed channel; said bounding wall of said first recessed channel being substantially planar except near said uppermost portion, and a portion of said bounding wall of said recessed channel at said uppermost portion being arcuate in shape curving smoothly toward said first one of the four sidewalls until it joins said first one of the four sidewalls;

said uppermost portion of said first recessed channel being spaced from said upper rim;

said first recessed channel having a width between said channel sidewalls, and wherein said width of said first recessed channel tapers gradually in a direction from a lowermost portion adjacent to said bottom toward said uppermost portion;

an upper handle extending between said channel sidewalls, said upper handle being disposed near said uppermost portion of said first recessed channel;

a lower handle extending between said channel sidewalls, said lower handle being disposed near said lowermost portion of said first recessed channel;

a second recessed channel substantially identical to said first recessed channel, said second recessed channel being disposed in a second one of said four sidewalls; said second one of said four sidewalls being opposite from said first one of said four sidewalls; and a removable lid which has a surface recess for receiving a bottom rim portion of the trash receptacle body, such that said trash receptacle body can be supported atop said removable lid;

said lid being configured to serve also as a collar in order to permit stacking of two or more trash receptacles;

said trash receptacle body having a generally uniform wall thickness; and an outer surface of the trash receptacle body being smooth to facilitate cleaning and sterilization;

wherein formation of an air vacuum between an interior of the trash receptacle body and a trash can liner is prevented.

2. An improved trash receptacle according to claim 1, further comprising at least one label disposed on a sidewall of the trash receptacle body for identification of the contents of the trash receptacle.

3. An improved trash receptacle according to claim 1, wherein material forming the trash receptacle body is recyclable.

4. An improved trash receptacle according to claim wherein material forming the trash receptacle body is UV resistant.

5. An improved trash receptacle according to claim 1, wherein an internal volume of the trash receptacle body is about 28 U.S. gallons.

6. An improved trash receptacle according to claim 1, wherein the trash receptacle is formed of medium density polyethylene.

* * * * *